US005685464A

United States Patent [19]

Krueger

[11] Patent Number: 5,685,464

[45] Date of Patent: Nov. 11, 1997

[54] PLASTIC POUR SPOUT FOR CONTAINER SIDE WALL

[75] Inventor: Kevin R. Krueger, Brandon, Wis.

[73] Assignee: Wellman, Inc., Ripon, Wis.

[21] Appl. No.: 679,423

[22] Filed: Jul. 8, 1996

[51] Int. Cl.[6] ..... B67D 5/06

[52] U.S. Cl. ..... 222/528

[58] Field of Search ..... 222/528, 530, 222/538, 556; 229/125.04, 125.15

[56] References Cited

U.S. PATENT DOCUMENTS 2,288,042 6/1942 Spilman ..... 222/528
2,735,605 2/1956 Read .
2,757,830 8/1956 Hansen ..... 222/528
3,565,300 2/1971 Dietz et al. ..... 222/528
5,135,159 8/1992 Giblin et al. .
5,169,059 12/1992 Desmond et al. .

*Primary Examiner*—Philippe Derakshani
*Attorney, Agent, or Firm*—Andrus, Sceales, Starke & Sawall

[57] ABSTRACT

A one-piece thermoformed pour spout is adapted to be attached to the side wall of a container in a folded position which defines both the spout mounting frame and the two walls of a V-lipped spout. Locking features allow the spout to be secured in both the closed and opened positions.

12 Claims, 2 Drawing Sheets

PLASTIC POUR SPOUT FOR CONTAINER SIDE WALL

BACKGROUND OF THE INVENTION

The present invention pertains to an openable and recloseable pour spout for a container and, more particularly, to a one-piece pour spout formed from a plastic web or sheet which is attached to the container after the container is manufactured.

Recloseable pour spouts for containers made of paperboard and other materials are well known. Such pour spouts are made in many shapes and of many different types of materials. Some may be made of paper or paperboard, including paperboard spouts which are formed integrally with a paperboard container wall. It is also known to make the spouts separately of metal, plastic or other materials and to attach the spout to the container with adhesives, lamination techniques and the like. Spouts may be rectangular in shape or of a triangular shape defining a V-lipped spout edge.

U.S. Pat. No. 2,735,605 discloses a V-lipped pour spout of two piece construction, utilizing a portion of a carton wall and a separate paperboard piece adhesively attached to the inside of the carton. U.S. Pat. No. 5,169,059 shows another V-lipped pour spout formed as an integral part of the carton wall. U.S. Pat. No. 5,135,159 shows a similar pour spout, formed of a single sheet of plastic and adhesively attached to the inside carton wall. The V-lipped panels can be pulled out through the container wall to form the open pouring position of the spout and pushed back therethrough to close it.

SUMMARY OF THE INVENTION

In accordance with the present invention, a plastic pour spout of one piece construction provides wide versatility of application which allows it to be attached to the outside face or inside face of the carton wall, attached prior to or after erecting the carton, and includes positive locking in both the closed and opened positions. The spout may be die cut from a plastic web and includes embodiments in which the spout blank is used in planer form or includes thermoformed portions displaced from the plane of the blank.

The unitary spout construction includes a peripheral mounting frame which defines a generally triangular shaped opening, the frame being adapted to be mounted around the edge of an opening in the container wall, either on the outside or on the inside thereof, with the apex of the triangular shaped opening pointing downwardly. A spout element has a hinged attachment to the mounting frame and includes a generally triangular first face portion which is shaped to correspond generally to the triangular shaped opening, a connecting portion which joins the first face portion to the mounting frame and includes a first fold line providing the hinged attachment, and a generally triangular second face portion which is joined to the first face portion along a common edge. The common edge defines a second fold line. The spout element is adapted to be initially folded on the first fold line to place the first face portion over the triangular shaped opening in the mounting frame to define a closed spout position. The first and second face portions are further adapted to be pulled partially through the triangular shaped opening in the mounting frame to cause the face portions to flex relative to one another on the second fold line to form the spout and to define an open spout position.

The first face portion preferably includes a stop surface which is joined thereto along a second common edge which defines a third fold line and is positioned to coincide with one edge of the triangular shaped opening in both the closed and open spout positions. The lower ends of the second and third fold lines intersect at the apex of the triangular shaped opening in both the closed and open spout positions. In the closed spout position, the second and third fold lines coincide with the edges of the triangular shaped opening which define the inverted apex thereof.

The upper edge of the first face portion extends between the upper ends of the second and third fold lines and defines one lip of the spout, and the upper edge of the second face portion intersects the upper end of the second fold line and defines the other lip of the spout. The edge of the first face portion which defines one lip of the spout preferably includes an integral upwardly extending pull tab to facilitate movement between the closed and open spout positions. The pull tab overlies a part of the mounting frame which defines the upper edge of the triangular shaped opening and acts to prevent reverse movement of the first face portion back through the opening. In a presently preferred embodiment, the first face portion is recessed adjacent the pull tab, along a line coincident with a part of the upper edge of the mounting frame opening, to engage that upper edge and hold the first face portion in the closed spout position. A portion of the mounting frame along one edge of the opening is also preferably recessed to receive the stop surface in response to folding the spout element on the first fold line.

In the preferred embodiment, the mounting frame includes a slot at one end of the upper edge of the triangular opening in the mounting frame, the slot being adapted to receive the other lip of the spout to guide movement thereof between the closed and opened positions. A locking detent is preferably formed in the surface of the second face portion and positioned to engage an adjacent edge of the triangular shaped opening in the mounting frame, when the spout is in the open position, to hold the spout in that position. To facilitate insertion of the spout element through the mounting frame opening, the connecting portion of the element may be provided with a fourth fold line positioned generally parallel to the first fold line.

DETAILED DESCRIPTION OF THE PREFERRED EMBODIMENT

A unitary plastic piece 10 (FIG. 1) is shaped and folded, and attached to the side wall of a container (FIG. 5) to provide a V-lipped pour spout 11 which can be opened and reclosed as will be described in greater detail hereinafter. The unitary spout piece 10 is preferably thermoformed from suitable plastic web stock having a thickness, for example, of about 0.010 inch (about 0.25 mm).

Figure 1:
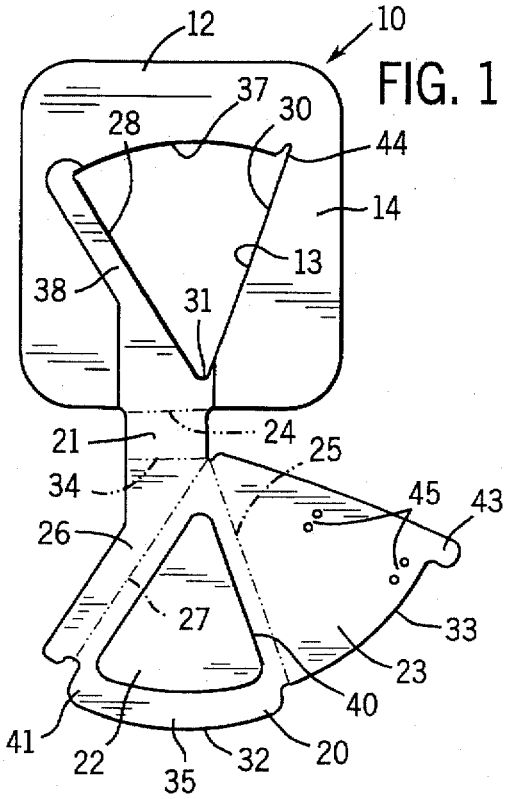
FIG. 1 is a plan view of the unitary thermoformed blank showing the preferred embodiment of the pour spout of the present invention.

The unitary plastic piece 10 includes a peripheral mounting frame 12 having a generally rectangular shape and defining a generally triangular central opening 13. As will be described, FIG. 1 shows the front face 14 of the mounting frame which, in one embodiment not shown in the drawings, may provide the spout mounting surface by which it is attached to the inside surface of one side wall 15 of a container 16 (see FIGS. 5 and 6). In the depicted embodiment, the opposite rear face 17 of the mounting frame 12 is adhesively attached to the outside surface of the container side wall 15 such that the triangular opening 13 surrounds a suitably formed opening 18 in the side wall for the discharge of the contents of the container. The spout is particularly adapted to be used with dry granular contents which are typically discharged by pouring.

The unitary plastic piece 10 includes a spout element 20 formed integrally with and attached to the mounting frame 12 by a narrow connecting portion 21. The spout element 20 includes a generally triangular first face portion 22 which is shaped to correspond generally to the triangular opening 13 in the mounting frame 12. The connecting portion 21 is scored to form a first fold line 24 which allows the spout element 20 to be folded over the mounting frame 12 to an initial assembly position against the rear face 17 thereof, as is shown best in FIG. 2, but before the mounting frame is attached by its rear face 17 to the outside surface of the container sidewall 15. A generally triangular second face portion 23 is joined to the first face portion 22 along a common edge which scored to define a second fold line 25. One edge of the first face portion 22 includes an integral stop surface 26 which is joined to the first face portion along a scored common edge which defines a third fold line 27. When the spout element 20 is folded over against the rear face of the mounting frame 12, the third fold line 27 coincides with one edge 28 of the triangular frame opening 13. As will described, the coincidence between the third fold line and the edge 28 of the opening is maintained in both the closed and open spout positions. The other edge 30 of the triangular opening 13 converges downwardly with opening edge 28 such that the apex 31 of the opening points downwardly when the mounting frame is attached to the carton wall. The ends of the second and third fold lines 25 and 27, respectively, intersect the apex 31 of the opening in both closed and opened spout positions. Further, the second and third fold lines 25 and 27 respectively coincide with the edges 30 and 28 of the opening 13 in the closed spout position, all as will become more readily apparent in the description which follows.

The upper edge 32 of the first face portion 22 thus extends between the upper ends of the second and third fold lines 25 and 27 and defines one lip 35 of the spout 11. The upper edge 33 of the second face portion 23 intersects the upper end of the second fold line 25 and defines the other lip of the spout.

Figure 2:
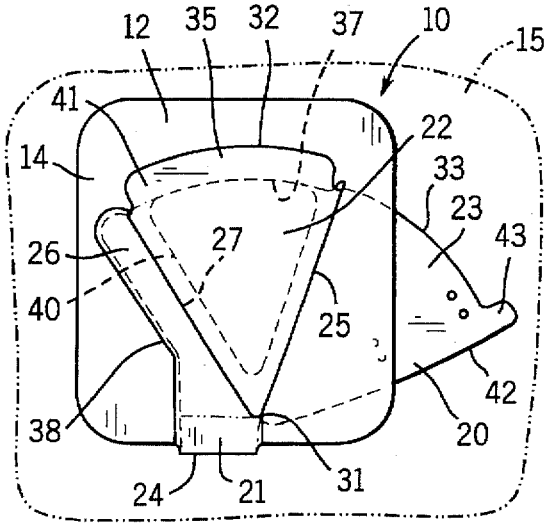
FIG. 2 is a plan view of the spout element of FIG. 1 after one side has been folded over the other to the operative position.
Figure 3:
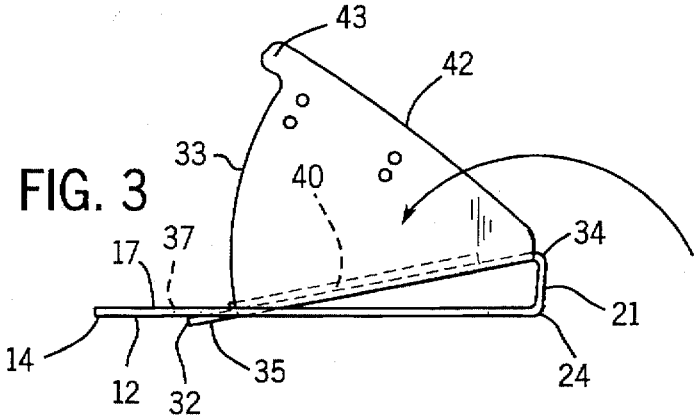
FIGS. 3 and 4 are side elevation views showing the sequence of folding to reach the FIG. 2 position.
Figure 4:
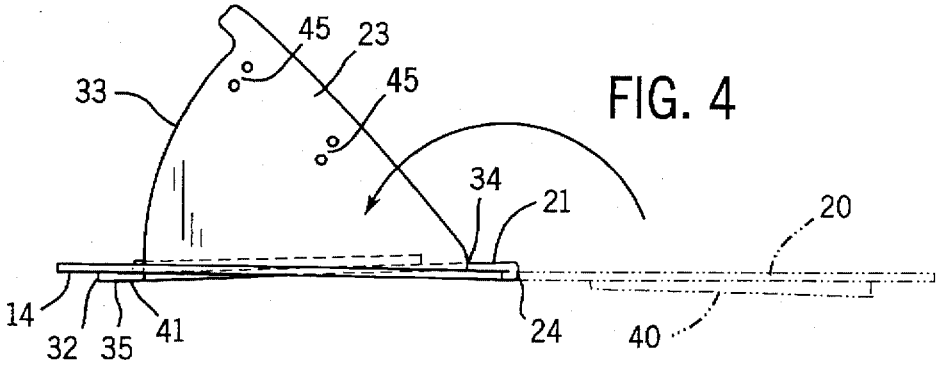

The connecting portion 21 is provided with a fourth fold line 34 which is used to facilitate folding and insertion of portions of the spout element 20 through the opening 13 in the mounting frame 12. Referring also to FIGS. 3 and 4, before attachment of the mounting frame to the container wall 15, the spout element 20 is folded over against the rear face 17 of the mounting frame, by initially utilizing both the first fold line 24 and the fourth fold line 34 to allow the lip 35, defined by the upper edge 32 of the first face portion 22 to be inserted past the edge 37 of the triangular opening 13 and through the opening. Continued folding, from the FIG. 3 to the FIG. 4 position, flattens the connecting portion 21 against the rear face 17 of the mounting frame 12 and allows the lip 35 to slide over the front face 14 of the mounting frame adjacent the upper edge 37 thereof, as shown in FIGS. 2 and 4.

Figure 5:
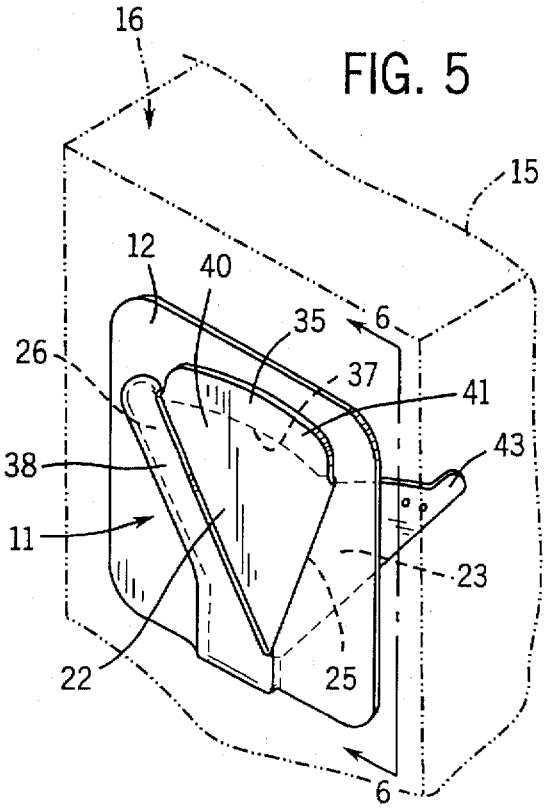
FIG. 5 is a perspective view of a generally prismatic carton showing attachment of the spout to one wall thereof in the closed spout position.

The mounting frame 12 adjacent edge 28 is provided with a recessed edge portion 38 which is thermoformed to be just deep enough to receive the stop surface 26 of the first face portion 22 as it is folded against the rear face of the mounting frame and is captured in the recessed portion 38 when the rear face 17 is subsequently adhesively attached to the outside of the container side wall 15, as shown in FIG. 5. In this position, the spout 11 is closed, the stop surface 26 is captured between the rear face of the mounting frame and the outside surface of the container side wall, and the second triangular face portion 23 extends freely into the interior of the container, attached to the first face portion 22 only along the second fold line 25. The first face portion 22 includes raised center portion 40 (FIG. 1) which becomes a recessed portion when viewed in the folded FIG. 2 position. In its mounted position on the container in FIG. 5, the upper edge of the raised center portion 40 engages the upper edge 37 of the mounting frame opening 13 to frictionally secure the first face portion 22 and establish the closed spout position.

Figure 7:
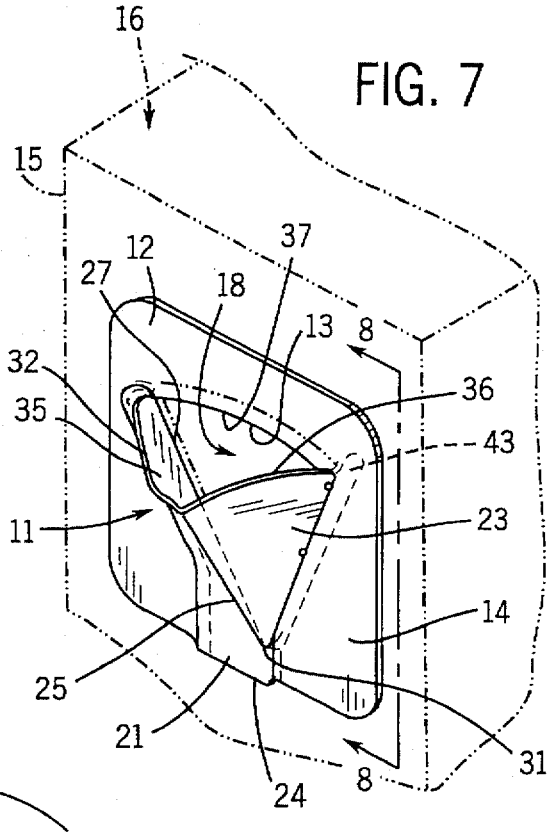
FIG. 7 is a perspective view, similar to FIG. 5, showing the open spout position.

In the closed position, the lip 35 defines a pull tab 41 which may be engaged by the fingernail of a user to pull the spout to the FIG. 7 open position. As the pull tab is moved outwardly, the locking raised center portion 40 is disengaged from the upper edge 37 of the opening 13. The first face portion 22 bends outwardly along the third fold line 27 and, simultaneously, the second face portion 23 of the spout element slides outwardly along the edge 30 of the opening, bending, as necessary, on the second fold line 25 with respect to the first face portion. The rear free edge 42 of the second face portion 23 is provided with a stop tab 43 at the upper end which engages the inside surface of the container side wall 15 when the spout reaches its full open position (FIG. 7).

Figure 6:
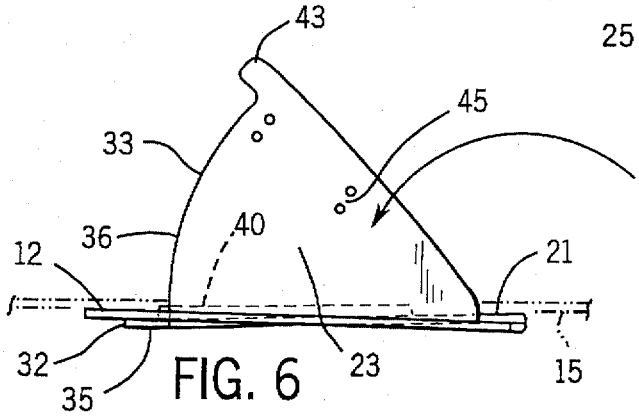
FIG. 6 is a sectional view taken on line 6—6 of FIG. 5.
Figure 8:
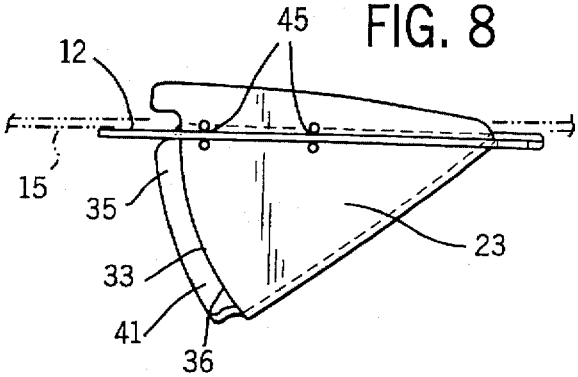
FIG. 8 is a sectional view taken on line 8—8 of FIG. 7.

Referring also to FIGS. 6 and 8, as the second face portion 23 slides along the edge 30 of the opening toward the open position, the upper edge 33 is retained in a slot 44 formed in the mounting frame at the upper end of edge 30 at its intersection with the upper opening edge 37. The slot 44 is just deep enough to retain the edge of the second face portion 23, but not to allow passage of the stop tab 43. Adjacent the rear edge 42 of the second face portion, there are formed pairs of upper and lower detents 45 between each of which the edge 30 of the opening 13 snaps and is held to retain the open spout position (FIG. 8).

I claim:

1. A unitary V-lipped pour spout for a wall of a container, said spout formed from a plastic sheet and comprising:

a peripheral mounting frame defining a generally triangular shaped opening, said frame adapted to be mounted around the edge of an opening in the container wall with the apex of said triangular shaped opening pointing downwardly;

a spout element having a hinged attachment to said mounting frame, said spout element including a generally triangular first face portion shaped to correspond generally to said triangular shaped opening, a connecting portion joining said first face portion to said mounting frame and including a first fold line providing said hinged attachment, and a generally triangular second face portion joined to said first face portion along a common edge, said common edge defining a second fold line;

said spout element adapted to be initially folded on said first fold line to place said first face portion over said triangular shaped opening to define a closed spout position; and, said first and second face portions adapted to be pulled partially through said triangular shaped opening to cause said first and second face portions to flex relative to one another on said second fold line to form said spout and define an open spout position.

2. The apparatus as set forth in claim 1 wherein said first face portion includes a stop surface joined thereto along a second common edge, said second common edge defining a third fold line and positioned to coincide with one edge of said triangular shaped opening in the closed and open spout positions.

3. The apparatus as set forth in claim 2 wherein the lower ends of said second and third fold lines intersect at the apex of said triangular shaped opening in the closed and open spout positions.

4. The apparatus as set forth in claim 2 wherein said second and third fold lines in the closed spout position coincide with the edges of said triangular shaped opening defining said apex.

5. The apparatus as set forth in claim 2 wherein the upper edge of said first face portion extends between the upper ends of said second and third fold lines and defines one lip of the spout, and the upper edge of said second face portion intersects the upper end of said second fold line and defines the other lip of the spout.

6. The apparatus as set forth in claim 5 wherein the edge of said first face portion defining one lip of the spout includes an integral upwardly extending pull tab to facilitate movement between the closed and open spout positions.

7. The apparatus as set forth in claim 6 wherein said pull tab overlies a part of the mounting frame defining the upper edge of said triangular shaped opening to prevent reverse movement of said first face portion through said opening.

8. The apparatus as set forth in claim 6 wherein said first face portion is recessed adjacent said pull tab along a line coincident with a part of the upper edge of said opening to engage said upper edge and hold said first face portion in the closed spout position.

9. The apparatus as set forth in claim 2 wherein said mounting frame includes a recessed edge portion adapted to receive said stop surface in response to folding said spout element on said first fold line.

10. The apparatus as set forth in claim 5 wherein said mounting frame includes a slot at one end of the upper edge of said triangular shaped opening for receipt of said other lip of the spout to guide movement thereof between said closed and open positions.

11. The apparatus as set forth in claim 10 further comprising a detent formed in the surface of said second face portion and adapted to engage an adjacent edge of said triangular shaped opening in the open spout position to hold the spout open.

12. The apparatus as set forth in claim 1 including a fourth fold line formed in said connecting portion generally parallel to said first fold line to facilitate insertion of said spout element through said mounting frame opening.

* * * * *